United States Patent [19]

Buzhinsky et al.

[11] 4,124,914

[45] Nov. 14, 1978

[54] WORKING TOOL OF A MACHINE FOR CLEANING THE OUTER SURFACE OF PIPES

[75] Inventors: Vladimir L. Buzhinsky; Konstantin E. Raschepkin; Mikhail G. Dunjushkin; Gennady T. Lysogorsky; Rustem I. Valeev; Yakov A. Nisenbaum; Deviz F. Ikhsanov, all of Ufa, U.S.S.R.

[73] Assignee: Vsesojuzny Nauchno-Issledovatelsky Institut Po Sboru, Podgotovke I Transportu Nefti I Nefteproduktov "Vniisptneft", U.S.S.R.

[21] Appl. No.: 788,022

[22] Filed: Apr. 15, 1977

[30] Foreign Application Priority Data

Apr. 21, 1976 [SU] U.S.S.R. ..... 2342903

[51] Int. Cl.[2] ..... B08B 9/02

[52] U.S. Cl. ..... 15/93 R; 15/88; 15/104.04

[58] Field of Search ..... 15/88, 93 R, 104.04; 144/208 R, 208 A, 208 F, 208 G; 118/DIG. 11

[56] References Cited

U.S. PATENT DOCUMENTS 3,994,766 11/1976 Dedels ..... 15/104.04 X

FOREIGN PATENT DOCUMENTS 201,852 1/1967 U.S.S.R. ..... 15/104.04

*Primary Examiner*—Edward L. Roberts

*Attorney, Agent, or Firm*—Robert E. Burns; Emmanuel J. Lobato; Bruce L. Adams

[57] ABSTRACT

Apparatus mountable on a pipeline of pipes welded end-to-end and having a self-propelled carriage mountable on the pipeline for travelling thereon. The carriage carries annular casings made to open up and receive the pipeline when mounting the carriage thereon and operble to a closed position circumferentially of the pipeline. A rotor travels in each casing circumferentially of the pipeline as the carriage moves axially of the pipeline. Each rotor has a tool holder that has a cleaning tool with a cutting edge tangential to the pipeline for cleaning. A cam surface on the tool holder moves in advance of the cutting edge and cams the tool holder upwardly when a weld is encountered between the pipe sections so that the cleaning tool is well protected.

2 Claims, 6 Drawing Figures

WORKING TOOL OF A MACHINE FOR CLEANING THE OUTER SURFACE OF PIPES

BACKGROUND OF THE INVENTION

The invention relates to the equipment for maintenance of mainlines, and more particularly, to a working tool of a machine for cleaning the outer surface of welded pipes from old artirust coating, rust and dirt.

It is known that antirust coating of operating mainlines is destroyed in time under the action of external factors (temperature differences, mechanical damages and the like). Pipe metal corrodes in the places of destruction of antirust coating so that even perforations of pipe walls may appear, especially in the zones of location of transverse welded joints of the pipeline due to differences between the weld metal and parent metal of the pipe, this action being much stronger in case of underground pipelines acted upon by soil electrolyte.

Service life of antirust coatings is considerably shorter than that of metal pipes so that it is necessary to of repair of antirust coatings at proper intervals.

The repair of mainlines, as a world-wide practice, is by replacing defective portions of pipeline by new ones. This requires suspension of product supply thus lowering the throughput capacity of the pipeline. It is therefore very important in the modern age to solve the problem of the overhaul of antirust coating of the outer surface of mainlines without interruption of product supply during the repair.

The invention may be most advantageously used for repair of operating mainlines of different diameters, in particular, gas and oil pipelines constructed of metal pipes welded-end-to-end.

Known machines for cleaning the outer surface of pipes of a mainline comprise a self-propelled carriage which is moved along the pipe being treated axially thereof during the cleaning and a working member mounted on the carriage which has a hollow casing accommodating an annular rotor co-axial with the pipe being treated which supports working tools.

Each working tool includes a tool holder in the form of a double-arm lever fixed to the rotor of the working member of the machine on the side of the pipe being treated for rotation in a plane extending at right angle to the pipe axis.

A tool is secured to the rear or trailing arm of the tool holder in the rotational direction of the rotor, and the front arm supports a counterweight for urging the tool against the surface of the pipe being treated during the cleaning under the action of centrifugal forces which are adjusted by the mass of the counterweight. The cutting edge of the tool in the prior art working tools extends, during the cleaning, in a plane tangential to the outer surface of the pipe being treated at an angle to the generatrix thereof.

Each working tool is provided with a cam for retracting the tool from the surface of the pipe being treated in the zones of location of projections thereof (welded joints, patches). The cam of prior art working tools comprises a plate bearing a cam and a support pivot arranged ahead of the tool in the rotational direction of the rotor. The plate is articulated to a pressure lever having an independent counterweight at the opposite end.

In the process of rotation of the rotor, the cam and the support pivot of the cam are urged against the surface of the pipeline by centrifugal forces developed at the counterweight. When the cam hits against a projection of the surface of the pipe being treated, such as against a welded joint, the plate rotates on the pivot relative to the articulation joint to cooperate with the tool holder arm so as to retract the tool from the welded joint thereby protecting the joint during cleaning. After the tool passes over the welded joint, the plate returns it back to the initial position.

The main disadvantage of the working tools of prior art machines for cleaning the outer surface of pipes resides in relatively complicated construction of the above-described cam which requires frequent adjustment and control of its cooperation with the tool under heavy dynamic and impact loads in the process of cleaning so as to avoid damages to the welded joints and to the surface of the pipe being treated. This results in frequent interruptions of the machine operation and lowers its productivity.

SUMMARY OF THE INVENTION

It is an object of the invention to provide a working tool of a machine for cleaning the outer surface of pipes in which the adjustment of the tool and cam is substantially dispensed with.

Another object of the invention is to provide for reliable protection of welded joints of a pipeline against damages in the process of cleaning.

Still another object of the invention is to provide for efficient removal of cleaning wastes from the treatment zone and self-cleaning of the tool.

These and other objects are accomplished in a working tool of a machine for cleaning the outer surface of pipes comprising a tool holder in the form of a double-arm lever fixed to a rotor of the working member of the machine on the side of the pipe being treated for rotation in a plane extending at right angle to the pipe axis. The rear arm of the lever in the rotational direction of the rotor supports a tool and the front arm carries a counterweight for urging the tool against the surface of the pipe being cleaned during the cleaning. The tool holder also has a cam for retracting the tool from the pipe surface in the zones of projections thereof. According to the invention, the cam comprises a tool holder edge adjacent to the cutting edge of the tool and extending, during the cleaning, substantially in one and the same plane therewith which is tangential to the surface of the pipe being treated.

This construction enables substantial elimination of relative adjustment and control of the cam and tool due to rigidity of their interconnection, whereby the reliable protection of welded joints and pipeline surface against damages during the cleaning is ensured. This construction of the cam also enables smooth retraction of the cutting edge of the tool from the zones of location of welded joints of the pipeline during the cleaning.

All the above features contribute to considerable improvement of the quality of the cleaning and machine to performance.

In accordance with one embodiment of the invention, the tool may comprise an end of the tool holder arm which is bent in the direction of movement of the machine during the cleaning in such a manner that the cutting edge of the tool extends at an obtuse angle to the side edge of the tool holder.

This construction enables the removal of cleaning wastes forwardly in the direction of the machine movement, as well as self-cleaning of the tool.

The front end portion and cutting edge of the tool are preferably rounded with a radius.

This provides for smoother passage of the cutting edge of the tool over irregularities of the outer surface of the pipeline (welded joints, patches and the like) while retaining the integrity of the cutting edge of the tool.

The cutting edge of the tool may be reinforced with a hard alloy so as to prolong the service life of the tool.

In accordance with further embodiment of the invention, the tool holder arms extend at an obtuse angle to each other on the side of the pipe being treated.

This construction of the tool holder makes it more compact in the radial direction of the working member of the machine.

BRIEF DESCRIPTION OF THE DRAWINGS

One embodiment of the invention will now be described with reference to the accompanying drawings, in which.

DESCRIPTION OF THE PREFERRED EMBODIMENT

Figure 1:
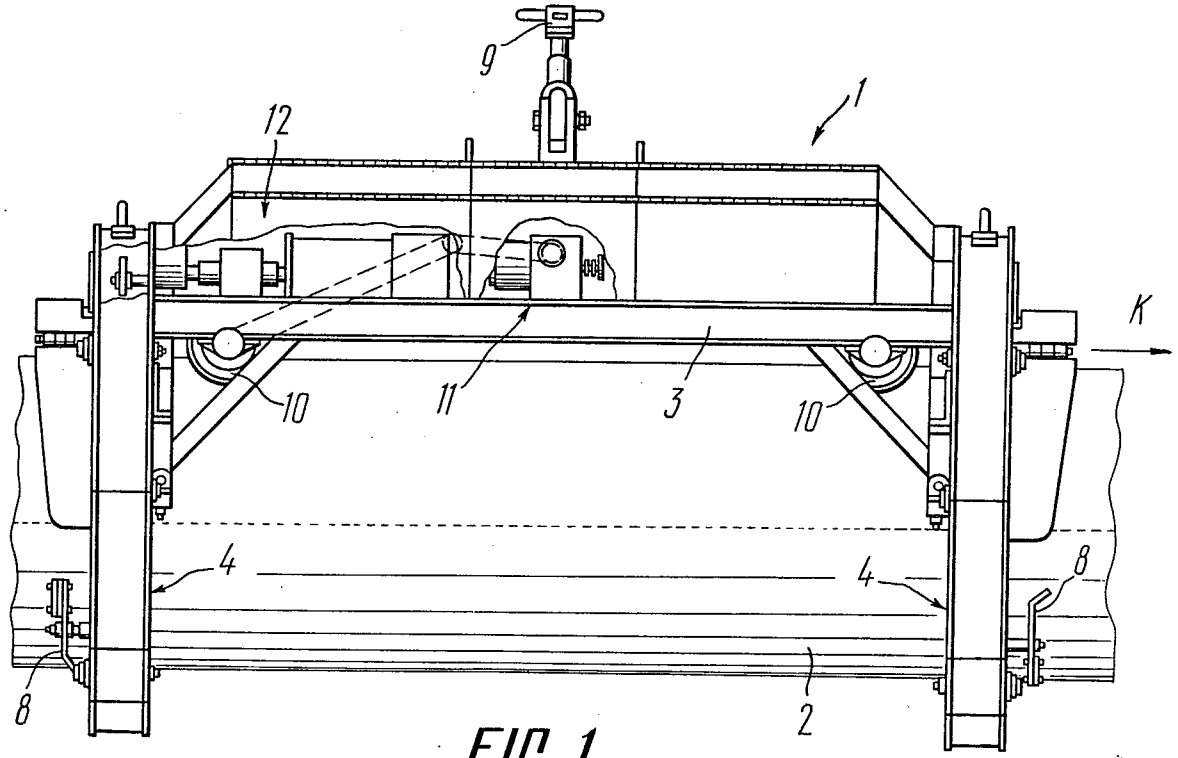
FIG. 1 is a general diagrammatic side view, partially in section, of a machine for cleaning the outer surface of a pipeline and having working tools according to the invention.
Figure 2:
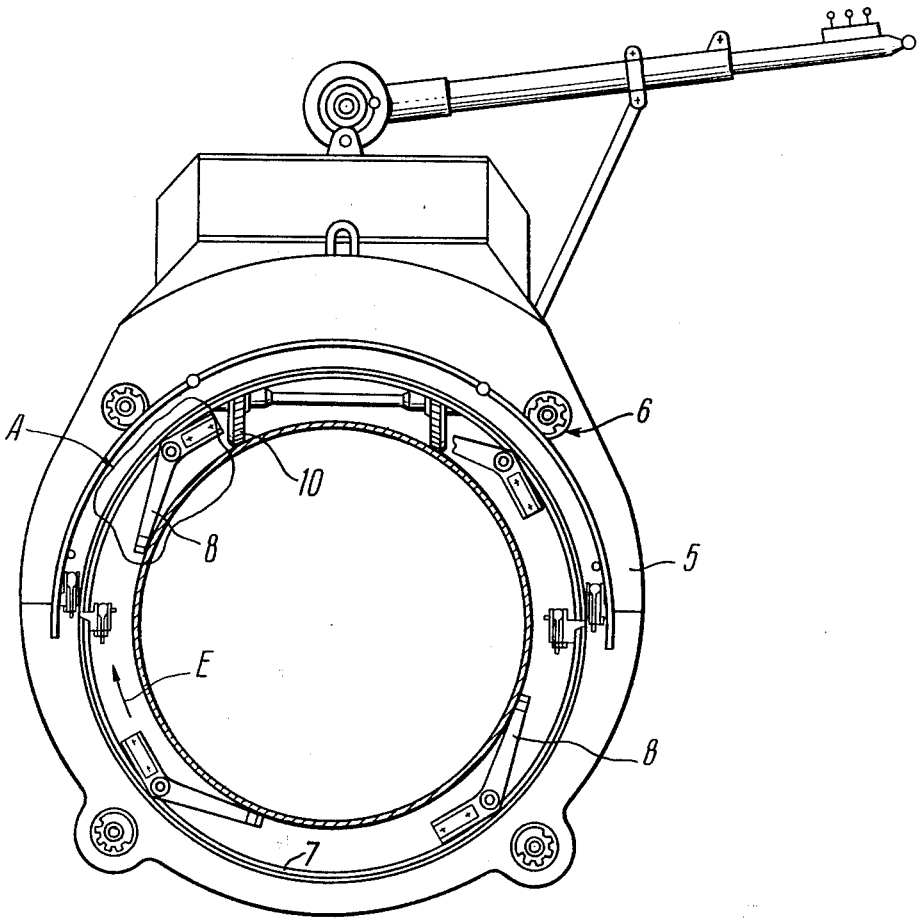
FIG. 2 is a front end elevation view of the same machine.

The invention will be described as applied to a working tool of a machine for cleaning the outer surface of a pipeline. The machine comprises a self-propelled carriage 1 (FIG. 1) which moves along the surface of a pipe 2 being treated axially thereof during the cleaning. A frame 3 of the self-propelled carriage 1 supports two working members 4. Each working member 4 has a hollow casing 5 (FIG. 2) provided with support rollers 6 and a split annular rotor 7 mounted in the support roller coaxially with the pipe 2 being treated and bearing replaceable working tools 8.

The machine has a remote control board 9 (FIG. 1) mounted to the frame 3 of the self-propelled carriage 1.

The frame 3 of the self-propelled carriage 1 is mounted on two pairs of running wheels 10 for movement of the carriage 1 along the surface of the pipe 2 being treated axially thereof during the cleaning.

The frame 3 of the self-propelled carriage 1 also supports a drive 11 for driving the wheels 10 and independent drives 12 of the rotors 7 of the working members 4.

In order to reduce reaction torques developed during rotation of the rotors 7 and to improve the cleaning of surface of the pipe 2 being treated adjacent to the welded joints, the rotors 7 are rotated in opposite directions.

Figure 3:
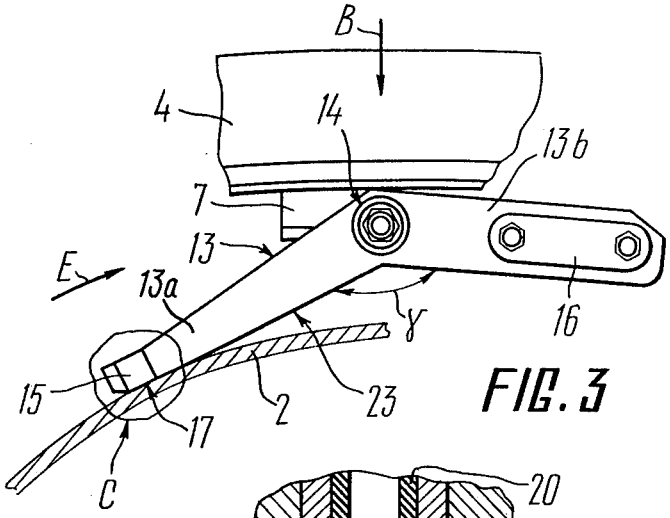
FIG. 3 is an enlarged view of detail "A" in FIG. 2.

Each working tool 8 has a tool holder 13 (FIG. 3) made in the form of a flat double-arm lever fixed to the rotor 7 of the working member 4 of the machine on the side of the pipe 2 being treated for rotation about a pivot 14 in a plane extending at right angle to the axis of the pipe 2.

Figure 4:
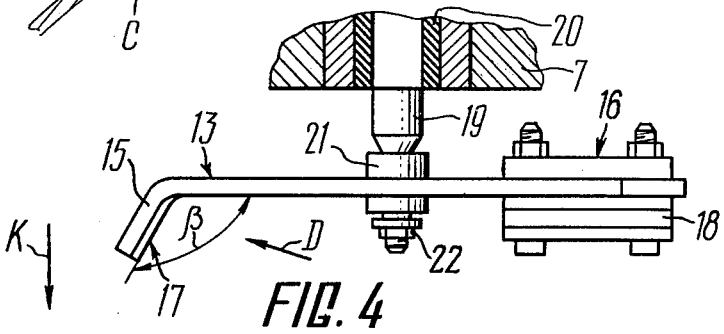
FIG. 4 is a fragmentary section view taken along the arrow "B" in FIG. 3.

A rear arm 13a of the tool holder 13 in the direction of rotation of the rotor 7 (shown by arrow "E" in FIGS. 2 and 3) supports a tool 15, and a front arm 13b supports a counterweight 16. A cutting edge 17 (FIGS. 4-6) of the tool 15 is urged against the surface of the pipe 2 being treated during the cleaning by centrifugal forces developed at the counterweight 16 during rotation of the rotor 7. The urging force is adjusted by using removable masses 18 of the counterweight 16.

An axle 19 of the pivot 14 of the tool holder 13 is fixed to the inner surface of the rotor 7 by means of a detachable joint (not shown) using a shock absorbing sleeve 20, and a bushing 21 rigidly fixed in a hole of the tool holder 13 and locked by means of a nut 22 is loosely fitted on the distal end of the axle 19.

Figure 5:
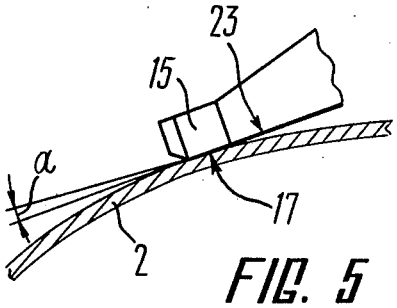
FIG. 5 is an enlarged fragmentary section detail "C" in FIG. 3.
Figure 6:
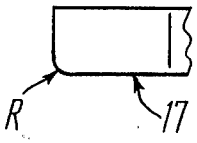
FIG. 6 is a view taken along the arrow "D" in FIG. 4.

For retraction of the tool 15 from the surface of the pipe 2 being treated in the zones of location of welded joints or other projections (not shown), the working tool 8 is provided with a cam 23 (FIG. 5). According to the invention, the cam 23 comprises an edge of the tool holder 13 adjacent to the cutting edge 17 of the tool 15 extending in one and the same plane therewith tangent to the surface of the pipe 2 being treated, or in a plane extending at an angle "$\alpha$" not greater than 10° to the tangent plane. The angle "$\alpha$" depends on the diameter of the pipe 2 being treated and degree of surface cleaning required.

In accordance with the invention, the tool 15 comprises an end of the tool holder 13 which is bent in the direction of movement of the machine (shown by arrows "K" in FIGS. 1 and 4) during the cleaning along the pipe 2 being treated axially thereof.

The cutting edge 17 of the tool 15 extends at an obtuse angle "$\beta$" to the side edge of the tool holder 13, the angle "$\beta$" depending on the cleaning conditions, diameter of the pipe 2 being treated and smoothness of retraction of the tool 15 from welded joints.

The arrangement of the cutting edge 17 of the tool 15 at an obtuse angle "$\beta$" to the side edge of the tool holder 13 also provides for efficient removal of cleaning wastes from the treatment zone in the direction "K" of the machine movement, as well as for self-cleaning of the tool 15.

For smooth passage of the cutting edge 17 of the tool 15 over irregularities of the outer surface of the pipe 2 being cleaned, as well as in order to reduce loads applied to the cutting edge 17 of the tool 15, the front end portion of the tool 15 is rounded with a radius "R" (FIG. 6) according to the invention. The cutting edge 17 of the tool 15 may also be rounded with a radius and reinforced with hard alloy for the same purpose.

According to the invention, the arms **13*a* and 13*b* of the tool holder 13 are inclined to the surface of the pipe 2 being treated relative to the axle 19 of the pivot 14** so as to extend at an obtuse angle "$\gamma$" to each other on the side of the pipe being treated.

In order to eliminate unbalance of the rotors 7, the working tools 8 are mounted to the rotors in diametrically opposite locations.

The machine for cleaning the outer surface of pipes of a mainline having the working tools 8 according to the invention functions in the following manner.

First, the drives 12 of the rotors 7 are put on to rotate the working tools 8 as indicated by arrow "E".

Then the drive 11 of the running wheels 10 of the self-propelled carriage 1 is put on, and the machine moves along the outer surface of the pipe 2 being treated axially thereof in the direction "K".

As a result of progressive movement of the self-propelled carriage 1 and rotation of the rotors 7, the working tools 8 perform the cleaning of the outer surface of the pipe 2 along a helical path.

The counterweight 16 (FIG. 3) of each working tool 8 is displaced under the action of centrifugal forces from the center of rotation to the periphery to rotate the tool holder 13 about the axis 19 of the pivot 14 and to urge the cutting edge 17 of the tool 15 and the cam 23 of the tool holder 13 against the outer surface of the pipe 2 being treated. As a result, the outer surface of the pipe 2 is cleaned, and cleaning wastes are rejected from the treatment zone forwardly in the direction "K" of the machine movement.

When the surface of the cam 23 hits against a welded joint projecting from the surface of the pipe 2 being treated (not shown), the cam 23 (which moves ahead of the cutting edge 17 of the tool 15) moves smoothly over the projection defined by the welded joint thereby retracting therefrom the cutting edge 17 of the tool 15 which extends in one and the same plane with the cam 23 tangent to the surface of the pipe 2.

As a result, the integrity of welded joints and surface of the pipe 2 being treated, and also of the cutting edge 17 of the tool 15 is retained, whereby the working tool according to the invention has considerably longer service life than prior art working tools.

After the tool 15 passes over the projection, it is smoothly returned back to the initial position tangential of the pipe.

What is claimed is:

1. Apparatus mountable on a pipeline for cleaning the outer surfaces of a pipeline made of a plurality of pipes welded end-to-end comprising, a self-propelled carriage mountable on a pipeline made of pipes welded end-to-end and having means for travelling axially on the pipeline during cleaning of outer surfaces thereof, at least one hollow annular casing fixed to said carriage for travelling with said carriage axially of said pipeline, said casing comprising members operable to a spaced apart position constituting an open position for accepting the pipeline therebetween when mounting the carriage on the pipeline and when dismounting the carriage and operable to a closed position enclosing the pipeline circumferentially for cleaning, a rotor on the casing travelling circumferentially of the pipeline when the casing is closed, a tool holder on said rotor travelling circumferentially of the pipeline and having a cleaning tool thereon having a cutting edge for cleaning the outer surface of the pipeline as said rotor transports the tool circumferentially of the pipeline as said carriage travels axially thereof, said toolholder having an integral cam surface disposed for travelling circumferentially of said pipeline with said cutting edge disposed tangentially to the surface of the pipeline and effective for maintaining the cutting edge clear of the welds to avoid damage thereto, and means biasing the toolholder for maintaining the cam surface and cutting edge tangential to the outer surface of the pipeline.

2. Apparatus mountable on a pipeline for cleaning the outer surfaces of a pipeline made of a plurality of pipes welded end-to-end according to claim 1, in which said cutting edge trails said cam surface and is disposed defining an obtuse angle with a side surface of the toolholder.

* * * * *